US006661321B1

(12) United States Patent
Chuang

(10) Patent No.: US 6,661,321 B1
(45) Date of Patent: Dec. 9, 2003

(54) ELECTROMAGNETIC SWITCH

(75) Inventor: Hung-Chieh Chuang, Nan-Tou Hsien (TW)

(73) Assignee: Tendex Electric Co., Ltd., San-Chung (TW)

( * ) Notice: Subject to any disclaimer, the term of this patent is extended or adjusted under 35 U.S.C. 154(b) by 0 days.

(21) Appl. No.: 10/232,939

(22) Filed: Aug. 30, 2002

(51) Int. Cl.[7] ..... H01H 67/02
(52) U.S. Cl. ..... 335/132; 335/202; 335/159
(58) Field of Search ..... 335/78–86, 124, 335/128, 131–132, 202, 159–162

(56) References Cited

U.S. PATENT DOCUMENTS 2,446,299 A * 8/1948 Frese ..... 335/120
2,606,260 A * 8/1952 Nelson ..... 335/120
4,513,269 A * 4/1985 Miyamoto ..... 335/160
4,616,202 A * 10/1986 Kakizoe ..... 335/133
5,886,601 A * 3/1999 Kitamura et al. ..... 335/129

* cited by examiner

*Primary Examiner*—Lincoln Donovan
(74) *Attorney, Agent, or Firm*—Christie, Parker & Hale, LLP

(57) ABSTRACT

An electromagnetic switch includes a socket, an electromagnetic module, and a contact module that is to be plugged into the socket and the electromagnetic module. The contact module includes a fixed contact member and a movable contact member that is rotatable relative to the fixed contact member between a first angular position for establishing a first circuit, and a second angular position for establishing a second circuit. The fixed contact member is formed with conductive blade portions that can be plugged into the socket.

1 Claim, 9 Drawing Sheets

ELECTROMAGNETIC SWITCH

BACKGROUND OF THE INVENTION

1. Field of the Invention

This invention relates to an electromagnetic switch, more particularly to an electromagnetic switch with a socket, an electromagnetic module, and a contact module that is to be plugged into the socket and the electromagnetic module.

2. Description of the Related Art

FIGS. 1 and 2 illustrate a conventional electromagnetic switch that includes a housing 3, first and second electromagnetic members 5, 6 mounted in the housing 3, a fixed contact member mounted in the housing 3 above the first and second electromagnetic members 5, 6, and a movable contact member 8 mounted in the housing 3 above the fixed contact member. Each of the first and second electromagnetic members 5, 6 includes a coil 51, a yoke 41 disposed below the coil 51, and an armature 61 disposed above the coil 51. The armature 61 of each of the first and second electromagnetic members 5, 6 has a pair of pushing arms 71 extending upwardly therefrom toward and pivoted to the movable contact member 8 via pivot studs 83 which are formed on two opposite ends of the movable contact member 8. First and second urging members 84, 85 are mounted in the housing 3 for respectively urging the opposite ends of the movable contact member 8 in an upward direction. The movable contact member 8 includes first and second movable contacts 821, 822, and is rotatable between a first angular position, in which, the first movable contact 821 is turned downwardly to electrically contact a first fixed contact 311 of the fixed contact member, which results from downward movement of the armature 61 of the first electromagnetic member 5 against an urging action of the first urging member 84 via the yoke 41 of the first electromagnetic member 5 upon actuation of the coil 51 of the first electromagnetic member 5, and a second angular position, in which, the second movable contact 822 is turned downwardly to electrically contact a second fixed contact 312 of the fixed contact member, which results from downward movement of the armature 61 of the second electromagnetic member 6 against an urging action of the second urging member 85 via the yoke 41 of the second electromagnetic member 6 upon actuation of the coil 51 of the second electromagnetic member 6.

The conventional electromagnetic switch is disadvantageous in that since all of the components thereof are mounted in the housing 3, the assembly operation is relatively inconvenient and time-consuming. As a consequence, the manufacturing cost of the conventional electromagnetic switch is significantly increased. Moreover, the repair and the mounting and dismounting of a plurality of conductive wires thereon are laborious, and the urging members 84, 85 tend to fail after a period of use.

SUMMARY OF THE INVENTION

Therefore, the object of the present invention is to provide an electromagnetic switch that dispenses with the use of the aforesaid urging members and that is capable of overcoming the aforesaid drawbacks of the prior art.

According to the present invention, there is provided an electromagnetic switch that comprises: an electromagnetic module including a first housing half and first and second electromagnetic members mounted in the first housing half, each of the first and second electromagnetic members including a coil, a yoke, and an armature movable when actuated by the yoke upon application of an electric current to the coil; a contact module including a second housing half connected to the second housing half and having a top wall, the contact module further including a fixed contact member and a movable contact member associated with the electromagnetic module, the fixed contact member being mounted in the second housing half and including conductive first and second fixed contacts and a conductive third fixed contact spaced apart from the first and second fixed contacts, the movable contact member being mounted in the second housing half and including conductive first and second movable contacts which are vertically and respectively aligned with the first and second fixed contacts, and a conductive third movable contact which is electrically connected to the first and second movable contacts and the third fixed contact, the movable contact member being rotatable relative to the fixed contact member among a first angular position, in which the first movable contact is in electrical contact with the first fixed contact, whereas the second movable contact is spaced apart from the second fixed contact when the coil of the first electromagnetic member is actuated, thereby establishing a first circuit passing through the first fixed contact, the first movable contact, the third movable contact, and the third fixed contact, a second angular position, in which the second movable contact is in electrical contact with the second fixed contact, whereas the first movable contact is spaced apart from the first fixed contact when the coil of the second electromagnetic member is actuated, thereby establishing a second circuit passing through the second fixed contact, the second movable contact, the third movable contact, and the third fixed contact, and a normal angular position, in which the first and second movable contacts are spaced apart from the first and second fixed contacts, respectively, when the coils of the first and second electromagnetic members are disabled, each of the first and third fixed contacts having a blade portion extending outwardly through the top wall of the second housing half; and a socket including a socket seat and conductive first and second socket contacts mounted on the socket seat, the socket seat being formed with first and second blade slots for insertion of the blade portions of the first and third fixed contacts and for electrical contact between each of the blade portions and a respective one of the first and second socket contacts.

BRIEF DESCRIPTION OF THE DRAWINGS

In the drawings which illustrate an embodiment of the invention.

Figure 1:
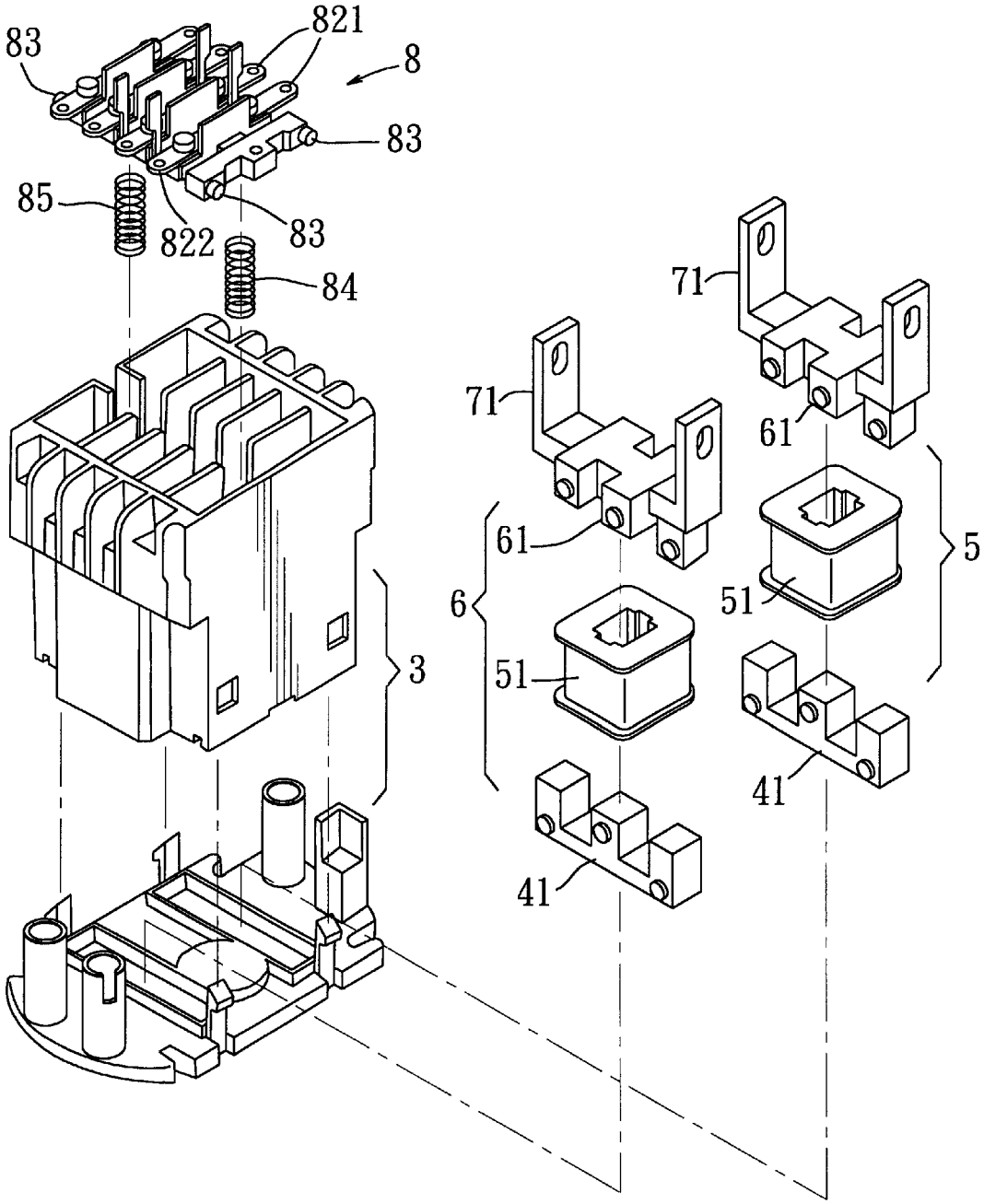
FIG. 1 PRIOR ART
FIG. 1 is an exploded perspective view of a conventional electromagnetic switch.
Figure 2:
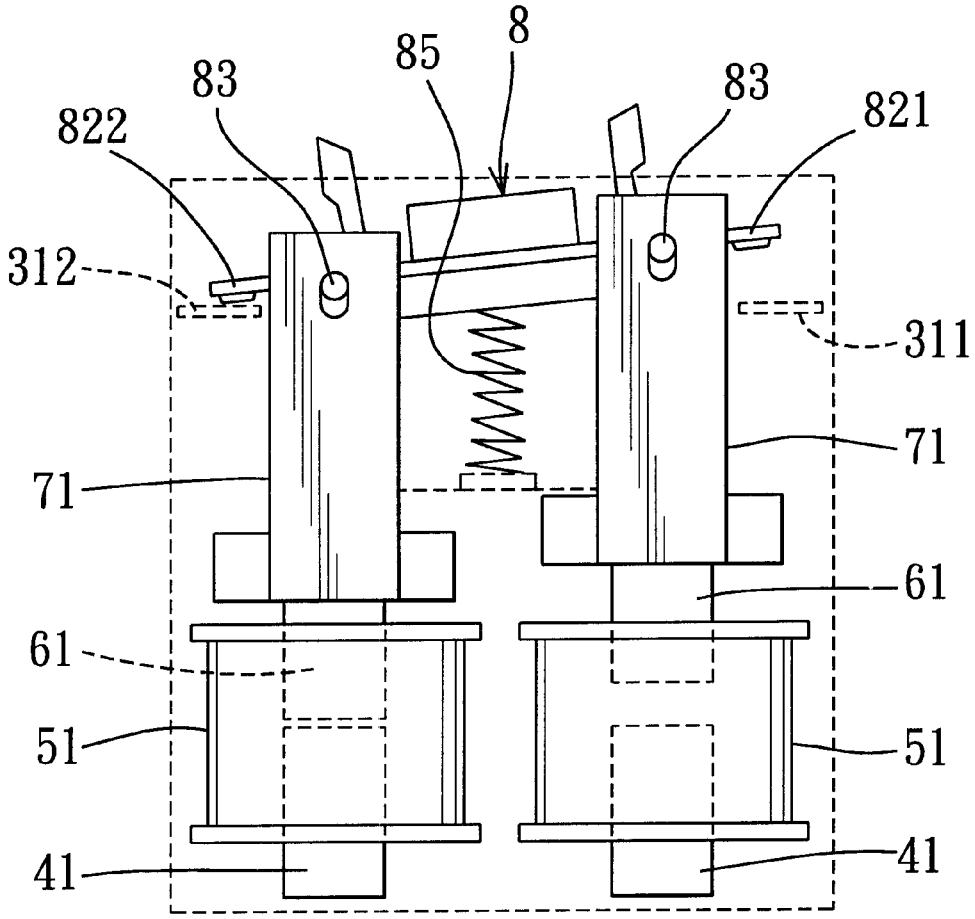
FIG. 2 PRIOR ART
FIG. 2 is a schematic view to illustrate how the electromagnetic switch of FIG. 1 works.
Figure 3:
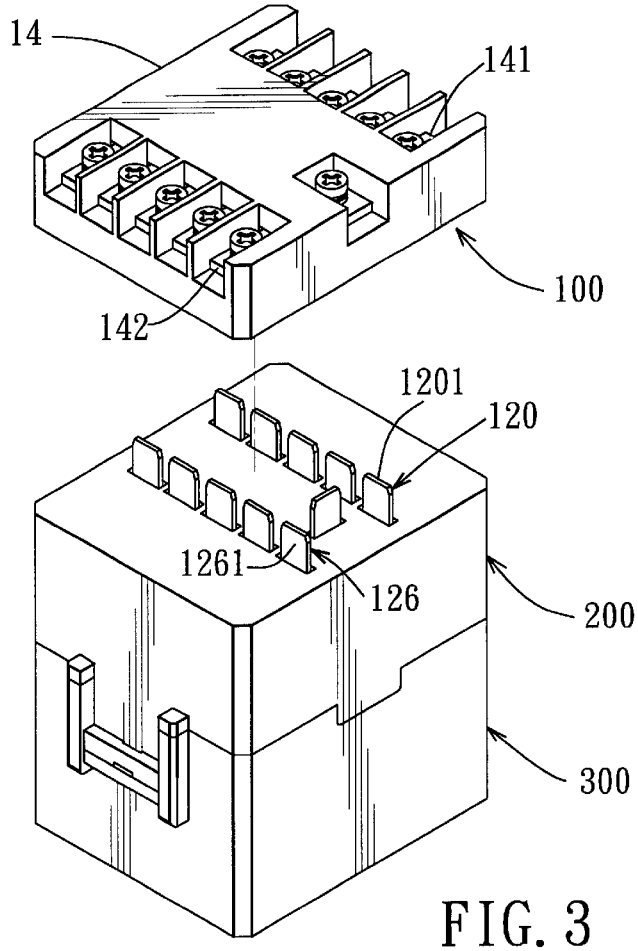
FIG. 3 is a partly exploded perspective view of a preferred embodiment of an electromagnetic switch according to this invention.
Figure 4:
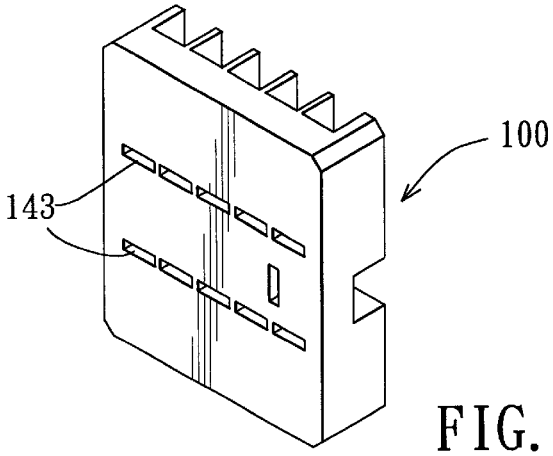
FIG. 4 is a bottom perspective view of a socket of the electromagnetic switch of FIG. 3.
Figure 5:
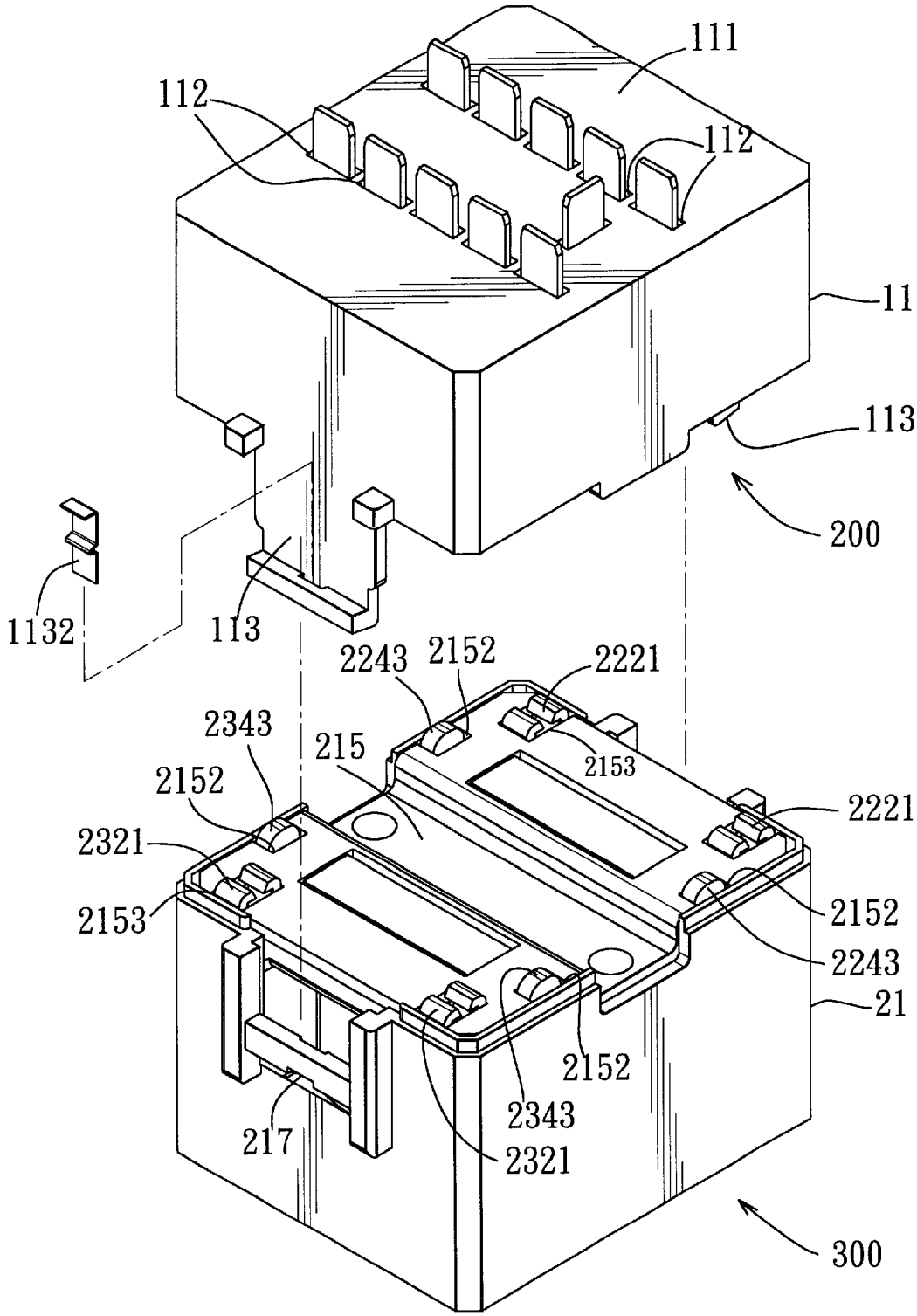
FIG. 5 is a partly exploded perspective view illustrating an electromagnetic module and a contact module of the electromagnetic switch of FIG. 3.
Figure 9:
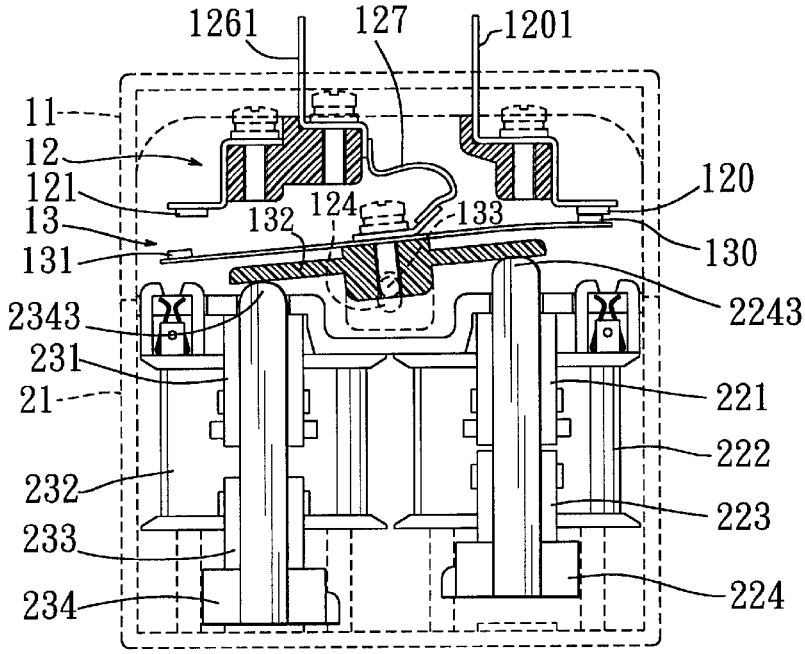
Figure 10:
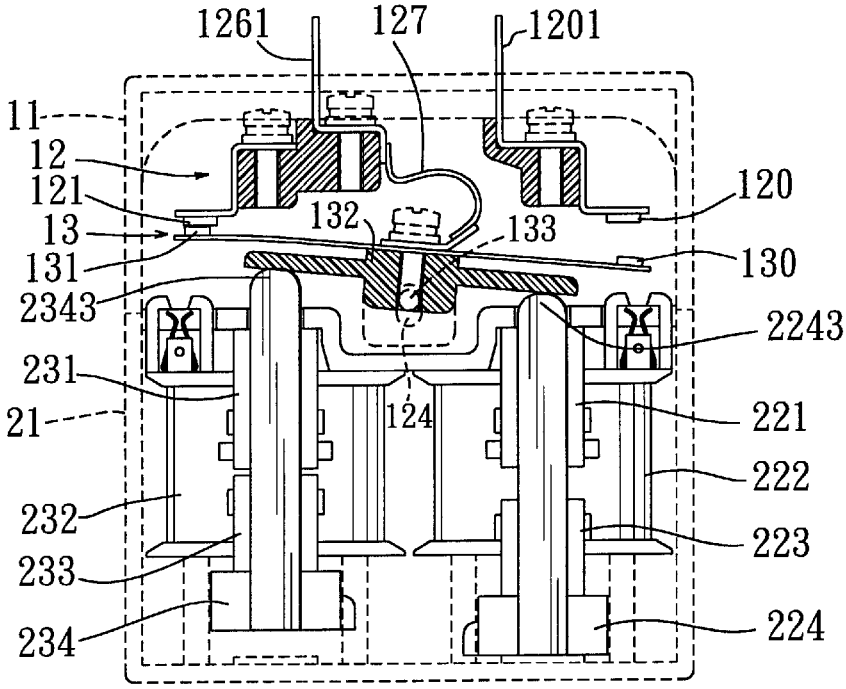
Figure 11:
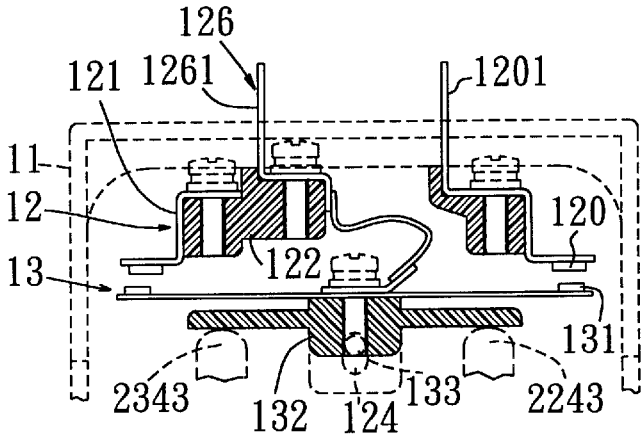
Figure 12:
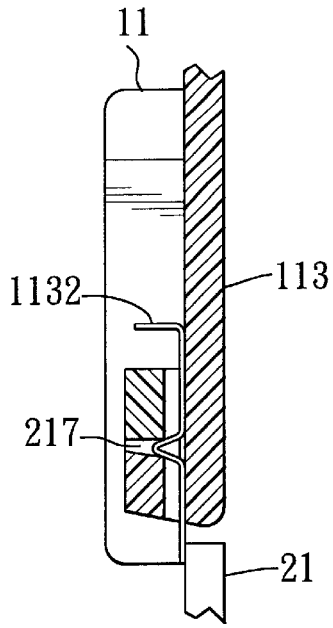
Figure 13:
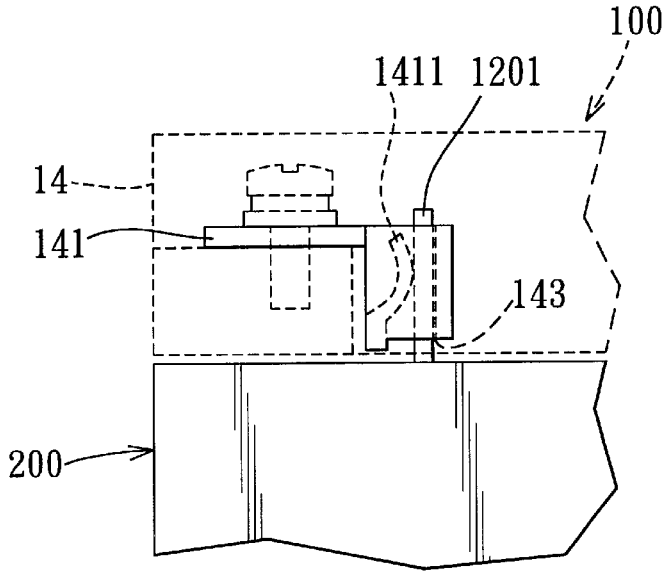

FIG. 9 is a partly sectional view of the movable contact member of the contact module shown in FIG. 5 when disposed at a first angular position relative to the fixed contact member of the contact module;

FIG. 10 is a partly sectional view of the movable contact member of the contact module shown in FIG. 5 when is disposed at a second angular position relative to the fixed contact member of the contact module;

FIG. 11 is a fragmentary sectional view of the movable contact member of the contact module shown in FIG. 5, which is disposed at an upper position relative to the fixed contact member of the contact module;

FIG. 12 is a fragmentary partly sectional view to illustrate how the contact module is secured to the electromagnetic module shown in FIG. 5; and FIG. 13 is a fragmentary schematic view to illustrate how a socket is plugged into the contact module shown in FIG. 3.

DETAILED DESCRIPTION OF THE PREFERRED EMBODIMENT

FIGS. 3 to 8 illustrate a preferred embodiment of an electromagnetic switch according to this invention. The electromagnetic switch includes a socket 100, an electromagnetic module 300, and a contact module 200 that is to be plugged into the socket 100 at one side and into the electromagnetic module 300 at an opposite side.

The electromagnetic module 300 includes first and second electromagnetic members 22, 23 (see FIG. 7), each of which includes a coil 222 (232), a yoke 221 (231) disposed above the coil 222 (232), and an armature 223 (233) disposed below the coil 222 (232) and movable upwardly when actuated by the yoke 221 (231) upon application of an electric current to the coil 222 (232). The electromagnetic module 300 further includes first and second pushing units 224, 234 connected to and projecting upwardly and respectively from the armatures 223, 233 of the first and second electromagnetic members 22, 23, and co-movable with the armatures 223, 233, respectively.

The contact module 200 includes a fixed contact member 12 disposed above the first and second electromagnetic members 22, 23 and including pairs of conductive first and second fixed contacts 120, 121 (only one pair of the first and second fixed contacts 120, 121 will be described in the following paragraphs), and a movable contact member 13 disposed between the electromagnetic module 300 and the fixed contact member 12 and including a movable seat 132 with two opposite sides, and pairs of conductive first and second movable contacts 130, 131 (only one pair of the first and second movable contacts 130, 131 will be described in the following paragraphs) which are respectively disposed at the opposite sides of the movable seat 132 and which are vertically and respectively aligned with the respective pair of the first and second fixed contacts 120, 121. The movable seat 132 is pivoted to the fixed contact member 12 so as to permit the movable contact member 13 to be rotatable relative to the fixed contact member 12 among a first angular position (see FIG. 9), in which the first movable contact 130 is in electrical contact with the first fixed contact 120, whereas the second movable contact 131 is spaced apart from the second fixed contact 121 when the coil 222 of the first electromagnetic member 22 is actuated, a second angular position (see FIG. 10), in which the second movable contact 131 is in electrical contact with the second fixed contact 121, whereas the first movable contact 130 is spaced apart from the first fixed contact 120 when the coil 232 of the second electromagnetic member 23 is actuated, and a normal angular position (see FIG. 8), in which the first and second movable contacts 130, 131 are spaced apart from the first and second fixed contacts 120, 121, respectively, when the coils 222, 232 of the first and second electromagnetic members 22, 23 are disabled.

The first and second pushing units 224, 234 respectively extend toward the opposite sides of the movable seat 132 in such a manner that the first pushing unit 224 is moved upwardly upon actuation of the armature 223 of the first electromagnetic member 22 so as to move the movable contact member 13 to the first angular position, and that the second pushing unit 234 is moved upwardly upon actuation of the armature 233 of the second electromagnetic member 23 so as to move the movable contact member 13 to the second angular position.

The electromagnetic module 300 further includes a first housing half 21 formed with a pair of opposing latch-engaging bars 217. The contact module 200 further includes a second housing half 11 which is formed with a pair of opposing latches 113 and which is detachably coupled to the first housing half 21 via engagement between each of the latches 113 and a respective one of the latch-engaging bars 217. An abutting member 1132 is disposed between and abuts against each of the latches 113 and the respective one of the latch-engaging bars 217 so as to tightly secure the first housing half 21 to the second housing half 11 (see FIG. 12). The first and second electromagnetic members 22, 23 are mounted in the first housing half 21. The fixed contact member 12 and the movable contact member 13 are mounted in the second housing half 11.

Each of the first and second pushing units 224, 234 includes an armature casing 2241 (2341) with two opposite ends, and a pair of pushing arms 2243 (2343) extending upwardly and respectively from the opposite ends of the armature casing 2241 (2341) for moving the movable contact member 13 to a respective one of the first and second angular positions. The first housing half 21 has a top open end 210 defining a top opening 212. The electromagnetic module 300 further includes a guiding plate 215 mounted on the top open end 210 of the first housing half 21 and covering the top opening 212, and formed with a plurality of first through-holes 2152 for extension of the pushing arms 2243 (2343) of the first and second pushing units 224, 234 therethrough, respectively, so as to guide upward and downward movements of the first and second pushing units 224, 234. Each of the armatures 223, 233 is secured in the respective one of the armature casings 2241, 2341 via a latch plate 2245 extending through the armature 223 (233) and the respective armature casing 2241 (2341).

The coil 222 (232) of each of the first and second electromagnetic members 22, 23 includes a top flange 2220 (2320) formed with a pair of conductive clamping members 2221 (2321). The guiding plate 215 is further formed with a plurality of second through-holes 2153 for extension of the clamping members 2221, 2321 of the top flanges 2220, 2320 of the coils 222, 232 of the first and second electromagnetic members 22, 23 therethrough, respectively. The fixed contact member 12 further includes a plurality of conductive terminal legs 1211 which are releasably and respectively gripped by the clamping members 2221, 2321 so as to permit the contact module 200 to be plugged into the electromagnetic module 300 and so as to permit electrical connection between each of the coils 222, 232 of the first and second electromagnetic members 22, 23 and electrical wires (not shown) via a respective one of the terminal legs 1211.

The fixed contact member 12 further includes a stationary seat 122 with two opposite sides. The first and second fixed contacts 120, 121 are disposed at the opposite sides of the stationary seat 122 of the fixed contact member 12, respectively. A pair of pivotal lugs 123 extend downwardly from two opposite ends of the stationary seat 122 of the fixed contact member 12 between the first and second fixed contacts 120, 121, and are formed with elongated slots 124, respectively. The movable seat 132 of the movable contact member 13 further includes a pair of pivot studs 133 that respectively extend into and that are movable within the elongated slots 124 so as to permit pivotal action of the movable contact member 13 relative to the fixed contact member 12 between the first and second angular positions.

Figure 6:
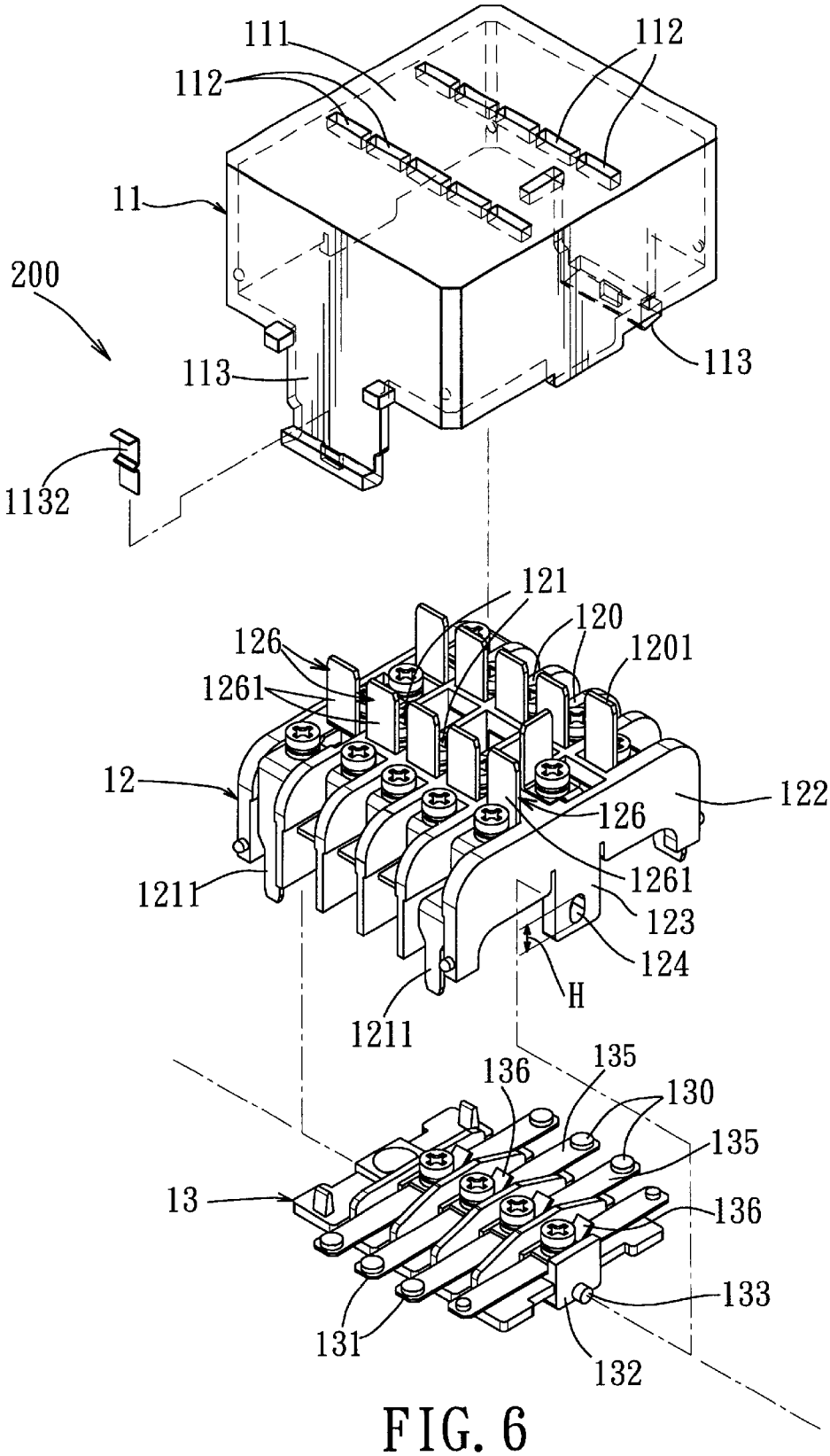
FIG. 6 is an exploded perspective view of the contact module shown in FIG. 5.
Figure 7:
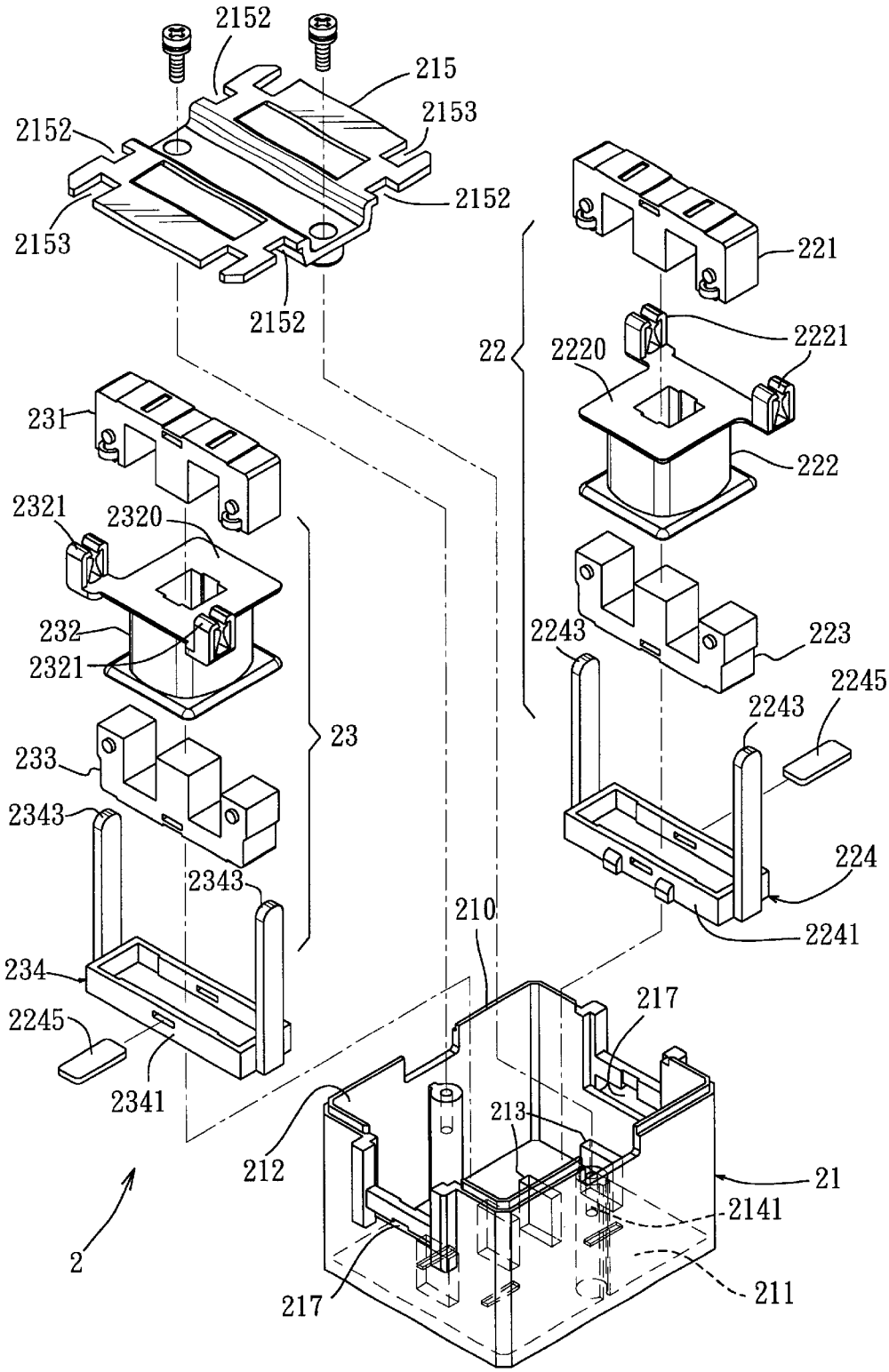
FIG. 7 is exploded perspective view of the electromagnetic module shown in FIG. 5.
Figure 8:
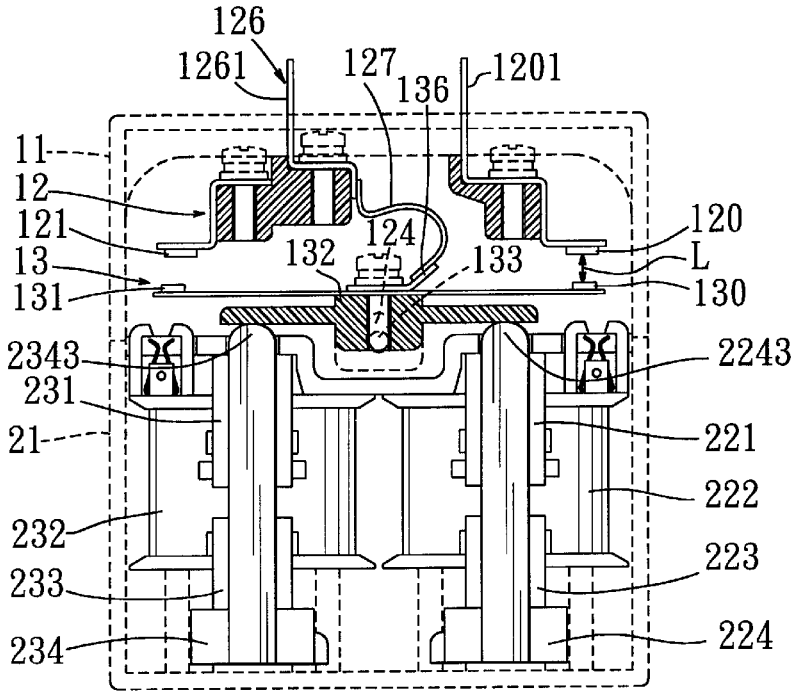
FIG. 8 is a partly sectional view to illustrate a movable contact member of the contact module shown in FIG. 5 when disposed at a normal angular position relative to a fixed contact member of the contact module.

Referring to FIG. 11, in combination with FIGS. 6 and 8, each of the first and second movable contacts 130, 131 of the movable contact member 13 is spaced apart from a respective one of the first and second fixed contacts 120, 121 by a vertical length (L) when the movable contact member 13 is disposed at the normal angular position. Each of the elongated slots 124 has a vertical height (H) that is less than the vertical length (L) so as to prevent simultaneous electrical contact between the first movable contact 130 and the first fixed contact 120 and between the second movable contact 131 and the second fixed contact 121 when the coils 222, 232 of the first and second electromagnetic members 22, 23 are simultaneously actuated. As shown in FIG. 11, the movable contact member 13 is moved upwardly to an upper position, in which, each of the pivot studs 133 abuts against a top end of a slot-confining wall of a respective one of the elongated slots 124, when the coils 222, 232 of the first and second electromagnetic members 22, 23 are simultaneously actuated.

Referring to FIGS. 3, 6 and 8, the second housing half 11 has a top wall 111 formed with a plurality of first and second openings 112. The movable contact member 13 further includes a plurality of conductive bridges 135 (only one of the bridges 135 will be described in the following paragraphs), each of which is mounted on the movable seat 132 and interconnects two of the first and second movable contacts 130, 131, and a plurality of conductive third movable contacts 136 (only one of the third contacts 136 will be described in the following paragraphs), each of which is electrically connected to the respective bridge 135 at a position between the first and second movable contacts 130, 131 in such a manner that the first and third movable contacts 130, 136 form a first circuit when the movable contact member 13 is disposed at the first angular position, and that the second and third movable contacts 131, 136 form a second circuit when the movable contact member 13 is disposed at the second angular position. The fixed contact member 12 further includes a plurality of conductive third fixed contacts 126 (only one of the third fixed contacts 126 will be described in the following paragraphs), each of which is in constant electrical contact with the respective third movable contact 136 via a conductive spring piece 127 so that the first circuit passes through the first fixed contact 120, the first movable contact 130, the third movable contact 136, and the third fixed contact 126, and that the second circuit passes through the second fixed contact 121, the second movable contact 131, the third movable contact 136, and the third fixed contact 126. Each of the first and third fixed contacts 120, 126 has a blade portion 1201 (1261) projecting upwardly and outwardly of the second housing half 11 from the stationary seat 122 through a respective one of the first and second openings 112.

The socket 100 includes a socket seat 14 and a plurality of conductive first and second socket contacts 141, 142 (only one of the first and second socket contacts 141, 142 will be described in the following paragraphs), each of which is mounted on the socket seat 14 for connection to electrical wires (not shown) and each of which has a spring arm portion 1411 (see FIG. 13). The socket seat 14 has a bottom formed with first and second blade slots 143 for insertion of the blade portions 1201, 1261 of the first and third fixed contacts 120, 126 and for electrical contact between each of the blade portions 1201, 1261 and the spring arm portion 1411 of a respective one of the first and second socket contacts 141, 142.

Since the contact module 200 can be plugged into the socket 100 and the electromagnetic module 300, the aforesaid drawbacks as encountered in the prior art can be eliminated. Moreover, the electromagnetic switch of this invention dispenses with the use of the aforesaid urging members employed in the conventional electromagnetic switch.

With the invention thus explained, it is apparent that various modifications and variations can be made without departing from the spirit of the present invention. It is therefore intended that the invention be limited only as recited in the appended claims.

I claim:

1. An electromagnetic switch comprising:

an electromagnetic module including a first housing half and first and second electromagnetic members mounted in said first housing half, each of said first and second electromagnetic members including a coil, a yoke, and an armature movable when actuated by said yoke upon application of an electric current to said coil;

a contact module including a second housing half connected to said second housing half and having a top wall, said contact module further including a fixed contact member and a movable contact member associated with said electromagnetic module, said fixed contact member being mounted in said second housing half and including conductive first and second fixed contacts and a conductive third fixed contact spaced apart from said first and second fixed contacts, said movable contact member being mounted in said second housing half and including conductive first and second movable contacts which are vertically and respectively aligned with said first and second fixed contacts, and a conductive third movable contact which is electrically connected to said first and second movable contacts and said third fixed contact, said movable contact member being rotatable relative to said fixed contact member among a first angular position, in which said first movable contact is in electrical contact with said first fixed contact, whereas said second movable contact is spaced apart from said second fixed contact when said coil of said first electromagnetic member is actuated, thereby establishing a first circuit passing through said first fixed contact, said first movable contact, said third movable contact, and said third fixed contact, a second angular position, in which said second movable contact is in electrical contact with said second fixed contact, whereas said first movable contact is spaced apart from said first fixed contact when said coil of said second electromagnetic member is actuated, thereby establishing a second circuit passing through said second fixed contact, said second movable contact, said third movable contact, and said third fixed contact, and a normal angular position, in which said first and second movable contacts are spaced apart from said first and second fixed contacts, respectively, when said coils of said first and second electromagnetic members are disabled, each of said first and third fixed contacts having a blade portion extending outwardly through said top wall of said second housing half; and a socket including a socket seat and conductive first and second socket contacts mounted on said socket seat, said socket seat being formed with first and second blade slots for insertion of said blade portions of said first and third fixed contacts and for electrical contact between each of said blade portions and a respective one of said first and second socket contacts.

* * * * *